US007731241B2

(12) United States Patent
Aoki et al.

(10) Patent No.: US 7,731,241 B2
(45) Date of Patent: Jun. 8, 2010

(54) ASSEMBLY FOR FITTING TOGETHER EXHAUST PIPES IN MULTI-CYLINDER ENGINE

(75) Inventors: Toshihide Aoki, Hamamatsu (JP); Toru Hisanaga, Hamamatsu (JP); Yuki Kiyo, Hamamatsu (JP); Takashi Wagatsuma, Hamamatsu (JP)

(73) Assignee: Yutaka Giken Co., Ltd., Hamamatsu-shi (JP)

( * ) Notice: Subject to any disclaimer, the term of this patent is extended or adjusted under 35 U.S.C. 154(b) by 12 days.

(21) Appl. No.: 12/106,281

(22) Filed: Apr. 19, 2008

(65) Prior Publication Data

US 2009/0000286 A1 Jan. 1, 2009

(30) Foreign Application Priority Data

Apr. 19, 2007 (JP) ..... 2007-110840

(51) Int. Cl.
*F16L 39/00* (2006.01)

(52) U.S. Cl. ..... 285/129.1; 285/125.1; 285/131.1

(58) Field of Classification Search ..... 285/125.1, 285/129.1, 129.2, 130.1, 131.1, 132.1, 288.1, 285/405, 416

See application file for complete search history.

(56) References Cited

U.S. PATENT DOCUMENTS 2,137,097 A * 11/1938 Sateren ..... 285/148.12
5,761,905 A * 6/1998 Yamada et al. ..... 60/322
6,205,778 B1 * 3/2001 Akaba et al. ..... 60/323

FOREIGN PATENT DOCUMENTS

JP 2000-240450 9/2000

* cited by examiner

*Primary Examiner*—Aaron M Dunwoody
*Assistant Examiner*—Fannie Kee
(74) *Attorney, Agent, or Firm*—Rankin, Hill & Clark LLP

(57) ABSTRACT

An assembly for fitting together multiple exhaust pipes in a multi-cylinder engine into a single unit is provided. The assembly includes a cap and a choke pipe connected to the cap. The cap includes a surface with multiple sockets protruding from the surface in a direction opposite to the choke pipe whereby the sockets engage the exhaust pipes. The cap also includes a skirt, which surrounds a perimeter of the surface. The skirt extends from the surface in a direction toward the choke pipe. An internal surface of the sockets, an internal surface of the skirt and an internal surface of the choke pipe are linearly arranged with respect to each other.

3 Claims, 9 Drawing Sheets

ASSEMBLY FOR FITTING TOGETHER EXHAUST PIPES IN MULTI-CYLINDER ENGINE

FIELD OF THE INVENTION

The present invention relates to an assembly for fitting together a plurality of exhaust pipes in a multi-cylinder engine into a single unit.

BACKGROUND OF THE INVENTION

In a multi-cylinder engine, exhaust pipes extend from the exhaust ports of the cylinders, and these exhaust pipes are brought together in an appropriate manner. The member used to bring the pipes together is an exhaust pipe manifold. Main exhaust pipes (usually one or two) extend from the exhaust pipe manifold and pass under the floor of the vehicle body to the rear of the body.

The exhaust pipe manifold inevitably has a complicated structure. In view of this, assemblies for fitting together a plurality of exhaust pipes are known, such as the one disclosed in Japanese Patent Application Laid-Open Publication No. 2000-240450 (JP 2000-240450 A). FIGS. 8 through 10 hereof show the assembly disclosed in JP 2000-240450 A.

Referring to FIG. 8, an assembly 100 is comprised of a perforated cap 101, a choke pipe 102 connected to the perforated cap 101, and a flange 103 provided at the exit of this choke pipe 102.

The choke pipe 102 is a cylinder in which the entrance has a large diameter, the exit has a small diameter, and the inside diameter decreases gradually.

The perforated cap 101 shown in FIG. 9 is comprised of a flat surface 104, a skirt 105 bent downward from the edge of the flat surface 104, a plurality (four in this example) of holes 106 formed in the flat surface 104, and sockets 107 formed by extending the edges of the holes 106 upward by means of burring. The distal ends (the bottom ends in the drawing) of exhaust pipes 108 are inserted into the sockets 107 and are fixed in place by welds 109, as shown in FIG. 8.

Since the skirt 105 is displaced further outward (to the left in the drawing) than the sockets 107 as shown in FIG. 10, pockets 111 can be formed in the portions enclosed by the bottom ends of the exhaust pipes 108, the top end of the choke pipe 102, and the skirt 105.

First currents 112 flowing along the internal peripheral surfaces of the exhaust pipes 108 form eddy currents in the pockets 111. These eddy currents increase pressure loss and are a hindrance to the flow of exhaust gas.

Second currents 113 slightly nearer to the center than the first currents 112 strike the internal surface of the choke pipe 102 and move in irregular fashion. The irregular movement creates turbulence and impedes the smooth flow of exhaust gas.

A smoother flow of exhaust is desired in the areas where the exhaust pipes are fitted together, and there is therefore a demand for a structure that does not cause eddy currents or turbulence.

SUMMARY OF THE INVENTION

An object of the present invention is to provide an assembly for fitting together a plurality of exhaust pipes that is free of eddy currents and turbulence.

According to the present invention, there is provided an assembly for fitting together a plurality of exhaust pipes in a multi-cylinder engine into a single unit. The assembly comprises a perforated cap and a choke pipe connected to the perforated cap, wherein the perforated cap has a flat surface, a skirt that is bent towards the choke pipe from the edge of the flat surface, and a plurality of sockets that protrude from the flat surface to allow the exhaust pipes to be inserted. Part of each of the sockets and part of the skirt are arranged linearly relative to each other.

Thus, placing part of each of the sockets and part of the skirt in a linear arrangement relative to each other allows the skirt to extend in linear fashion from the sockets, and the exhaust flowing through this region to therefore flow smoothly. Specifically, eddy currents do not arise because there are no pockets between the sockets and the skirt.

Preferably, the sockets are designed such that an approximate semi-circumference of each of the sockets is arranged linearly with the skirt. Thus, arranging the approximate semi-circumference of each of the sockets in a linear arrangement with the skirt allows a greater amount of exhaust gases to flow smoothly.

Desirably, the approximate semi-circumference of each of the sockets is parallel to the internal surface of the choke pipe. Thus, arranging the sockets parallel to the internal surface of the choke pipe allows the exhaust gases to flow smoothly through this region. Specifically, there is no concern that the exhaust gases flowing through the sockets will strike the internal surface of the choke pipe, and eddy currents do not arise.

It is desirable that the skirt have a flange at the bottom end thereof, the choke pipe have a flange at the top end, and the two flanges be joined together by welding.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
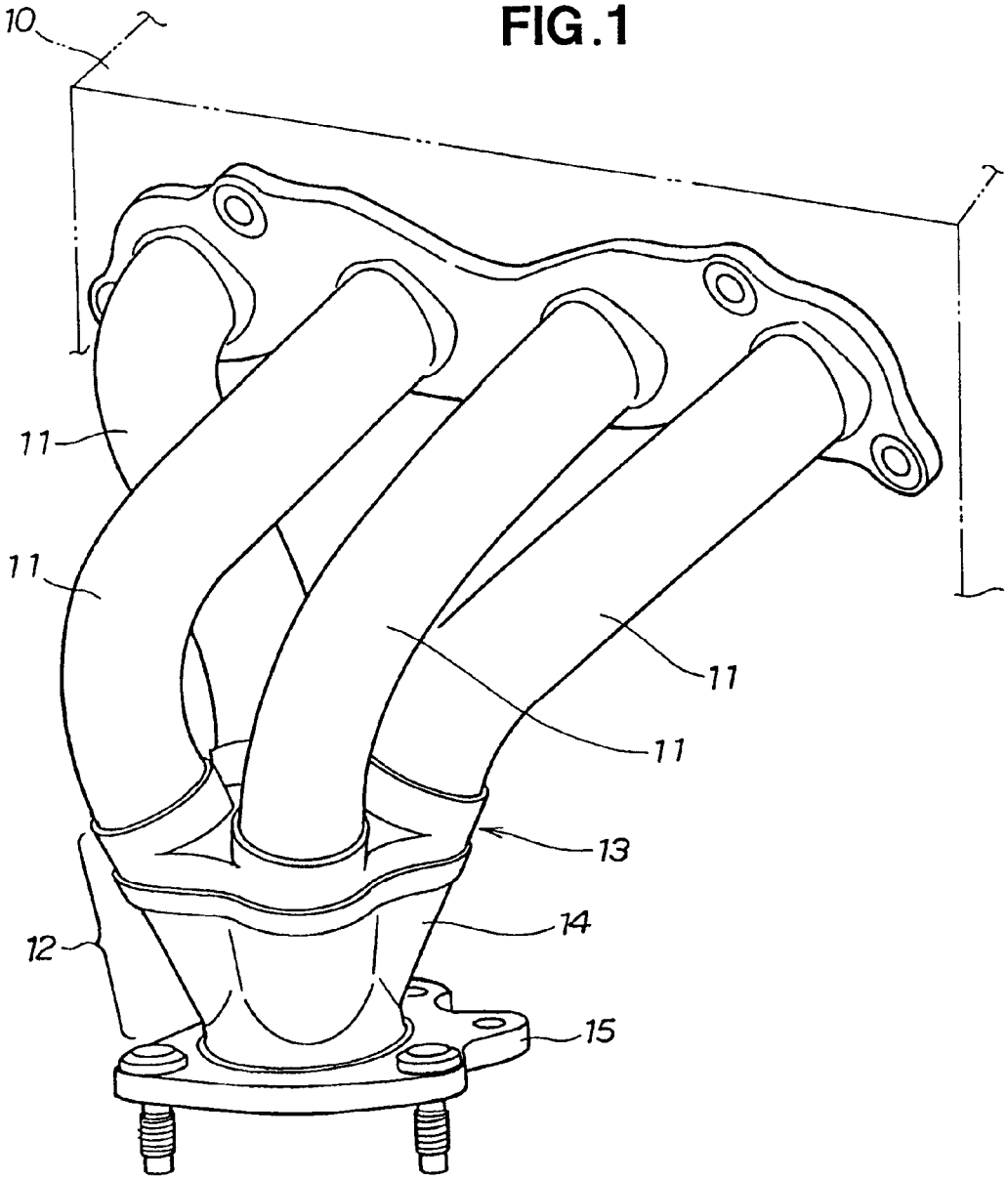
FIG. 1 is a perspective view of an exhaust system of a multi-cylinder engine employing an assembly according to a first embodiment of the present invention.

As shown in FIG. 1, four exhaust pipes 11 extend from a multi-cylinder engine 10 indicated by imaginary lines, and the bottom ends (distal ends) of these exhaust pipes 11 are brought together by an assembly 12.

The assembly 12 is comprised of a perforated cap 13, a choke pipe 14 connected to the perforated cap 13, and a connecting flange 15 attached at the end of the choke pipe 14 on the side that is smaller in diameter.

Figure 2:
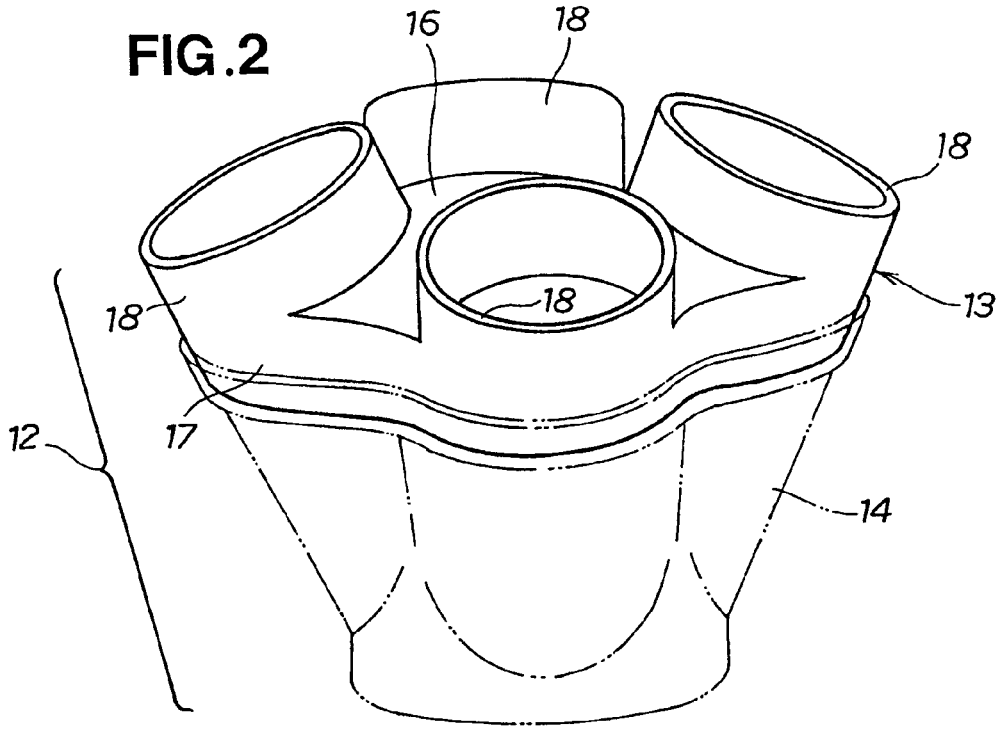
FIG. 2 is a perspective view of the assembly of FIG. 1.
Figure 3:
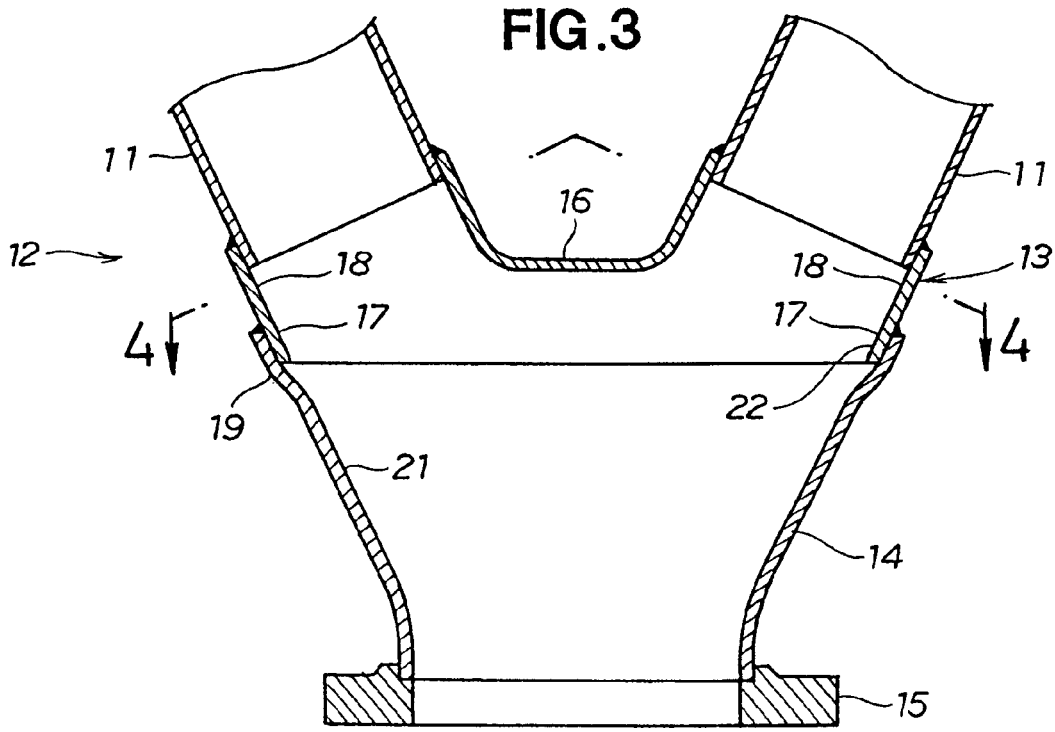
FIG. 3 is a cross-sectional view showing the assembly of FIG. 2.

The perforated cap 13 is comprised of a flat surface 16, a skirt 17 bent towards the choke pipe 14 from the edge of the flat surface 16, and four sockets 18 that protrude upward from the flat surface 16 to allow the exhaust pipes 11 to be inserted (see FIG. 1), as shown in FIGS. 2 and 3. The flat surface 16 is a reference surface or standard surface for machining.

Part of each of the sockets 18 and part of the skirt 17 are arranged linearly relative to each other.

Extending the skirt 17 in linear fashion from the sockets 18 allows exhaust gases to flow through this region smoothly. Specifically, eddy currents do not arise because there are no harmful pockets between the sockets 18 and the skirt 17.

Preferably, widening the top end of the choke pipe 14 commensurately with the thickness of the skirt 17 and inserting the skirt 17 into the widened part 19 allows the internal surface 22 of the skirt 17 to be lined up with the internal surface 21 of the choke pipe 14. Exhaust gases will then flow smoothly through this region.

Figure 4:
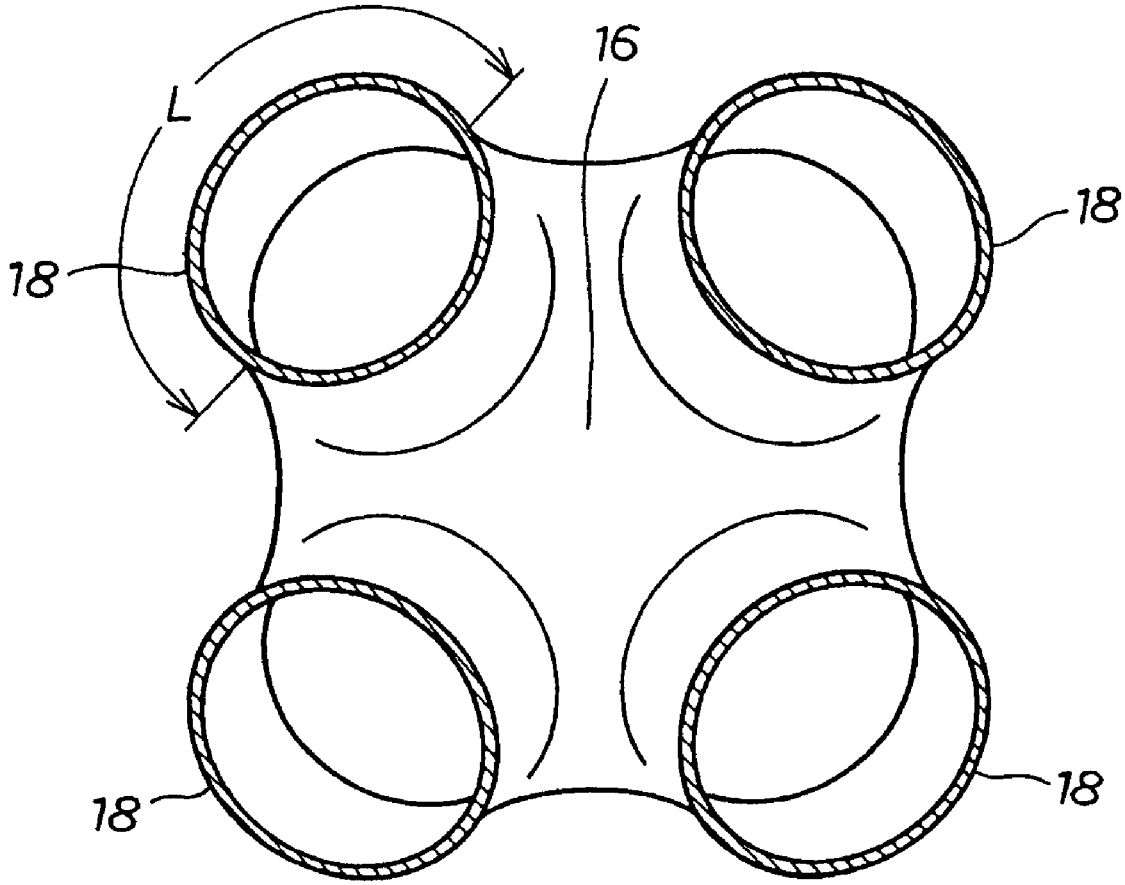
FIG. 4 is a cross-sectional view taken along line 4-4 of FIG. 3.

The approximate semi-circumference L of each of the sockets 18 is arranged linearly with the skirt 17, as shown in FIG. 4.

Returning to FIG. 3, it is preferable that the sockets 18 be parallel to the internal surface 21 of the choke pipe 14. Therefore, exhaust gases flowing through this region will flow smoothly. Specifically, there is no concern that the exhaust gases flowing through the sockets 18 will strike the internal surface 22 of the skirt 17, and eddy currents do not arise.

The following is a description of the method for manufacturing the perforated cap 13 described above.

FIGS. 5A through 5H show processes up to the plastic working of the sockets from a blank.

Figure 5A:
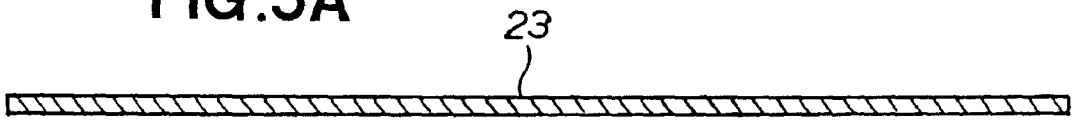
FIGS. 5A through 5H are cross-sectional views showing processes up to plastic working of sockets from a blank.

A blank 23 cut into a polygonal shape by a laser beam or another cutting device is provided as shown in FIG. 5A.

Figure 5B:
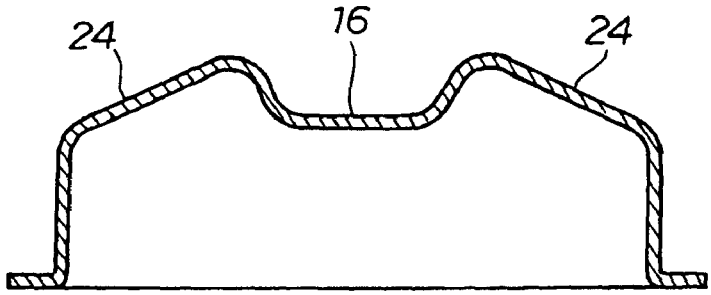

In FIG. 5B, the blank 23 is drawn. The drawing process forms protuberances 24, 24 that expand upwards from the flat surface 16.

Figure 5C:
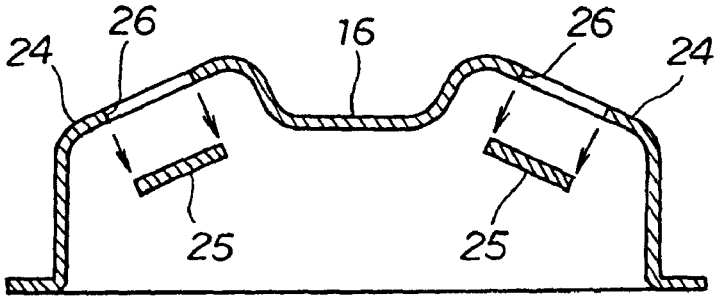

Disks 25, 25 are removed from the protuberances 24, 24 by a laser beam or another such cutting device, creating bottom holes 26, 26, as shown in FIG. 5C.

Figure 5D:
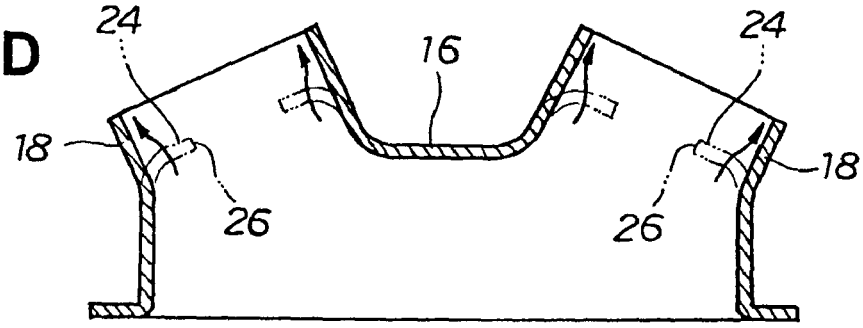

The protuberances 24, 24 are extended as indicated by the upward-pointing arrows, and sockets 18, 18 are formed by metal forming, as indicated by the imaginary lines in FIG. 5D. This metal forming is referred to as burring.

FIGS. 5E through 5H show the plastic working of the skirt 17.

Figure 5E:
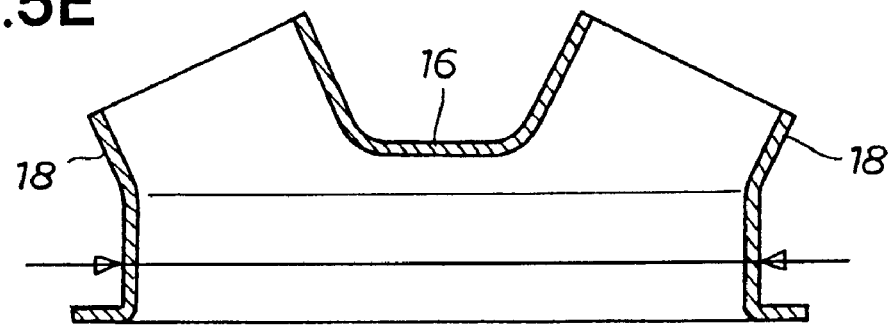

The bottom part of the metal-formed product is cut away as shown in FIG. 5E.

Figure 5F:
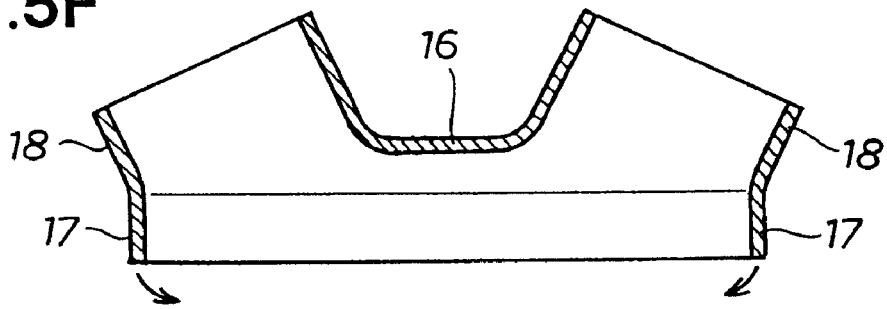

In FIG. 5F, the skirt 17 is bent as indicated by the arrows.

Figure 5G:
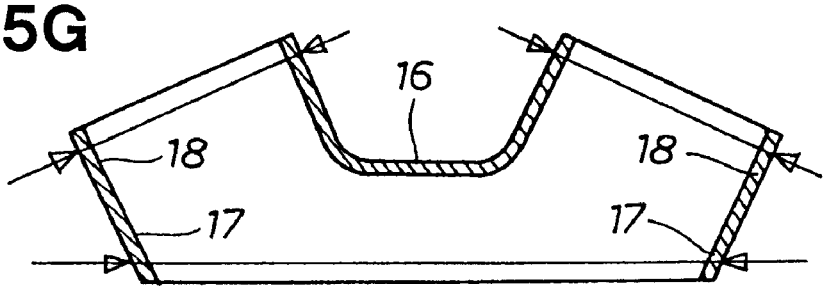

The sockets 18 and the skirt 17 are arranged linearly relative to each other, as shown in FIG. 5G. The top of the sockets 18 and the bottom of the skirt 17 are cut away.

Figure 5H:
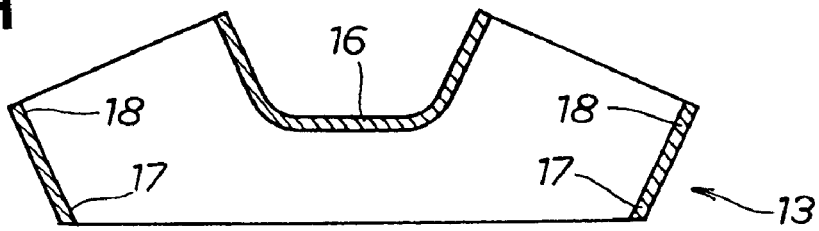

A perforated cap 13 is obtained as shown in FIG. 5H.

Figure 6:
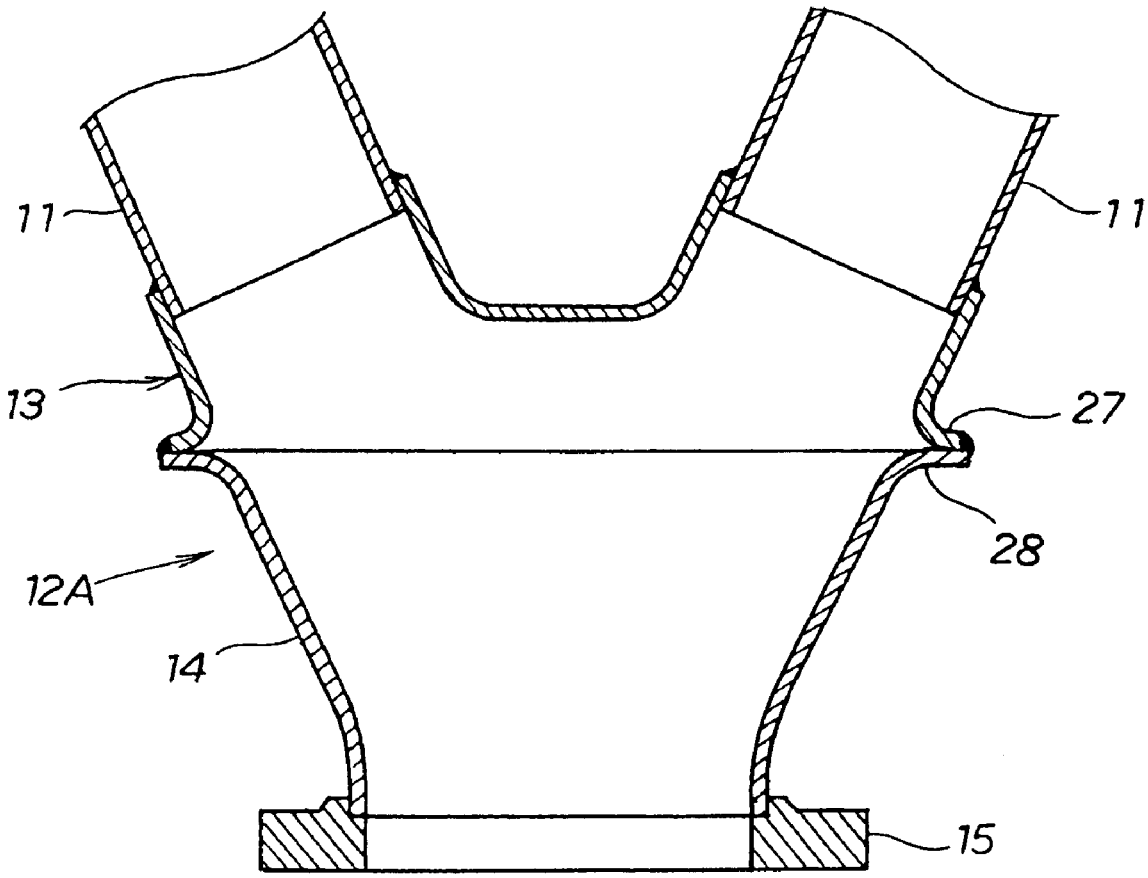
FIG. 6 is a cross-sectional view showing an assembly according to a second embodiment of the present invention.

FIG. 6 shows an assembly 12A of the second embodiment, in which an example of joining the perforated cap 13 and the choke pipe 14 together is depicted.

In the assembly 12A of the second embodiment, a flange 27 is formed at the bottom end of the perforated cap 13, a flange 28 is formed at the top end of the choke pipe 14, and the two flanges 27, 28 are joined and welded together.

Specifically, the perforated cap 13 and the choke pipe 14 may be connected by the flanges 27, 28 or by insertion of one into the other as shown in FIG. 3.

FIGS. 7A through 7D show the third embodiment, in which an example of a different number of sockets 18 is depicted.

Figure 7A:
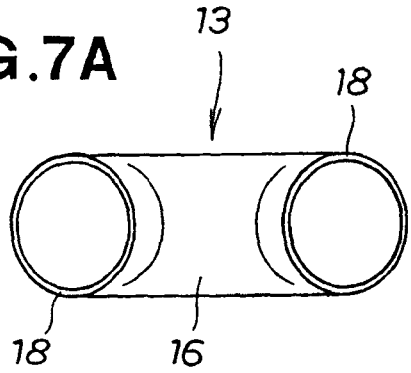
FIGS. 7A through 7D are schematic views showing an assembly according to a third embodiment of the present invention, which has a different number of sockets.

In FIG. 7A, an example is shown in which two sockets 18, 18 are provided in the perforated cap 13.

Figure 7B:
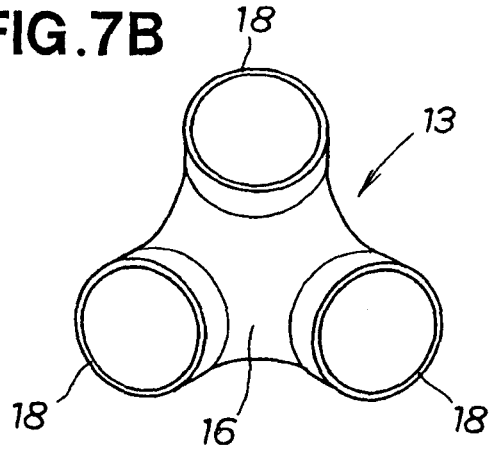

In FIG. 7B, an example is shown in which three sockets 18, 18, 18 are provided in the perforated cap 13.

Figure 7C:
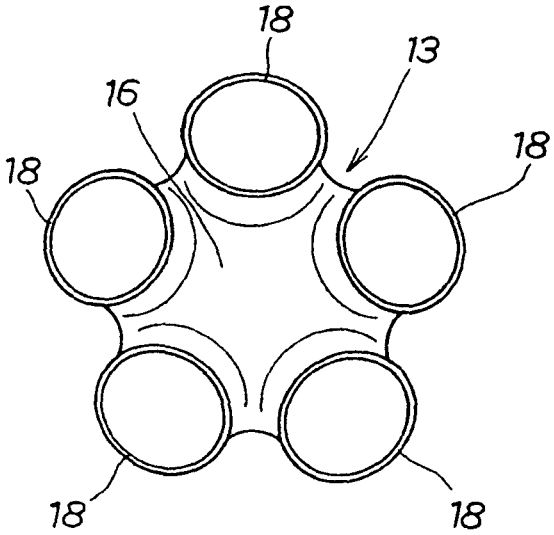

In FIG. 7C, an example is shown in which five sockets 18, 18, 18, 18, 18 are provided in the perforated cap 13.

Figure 7D:
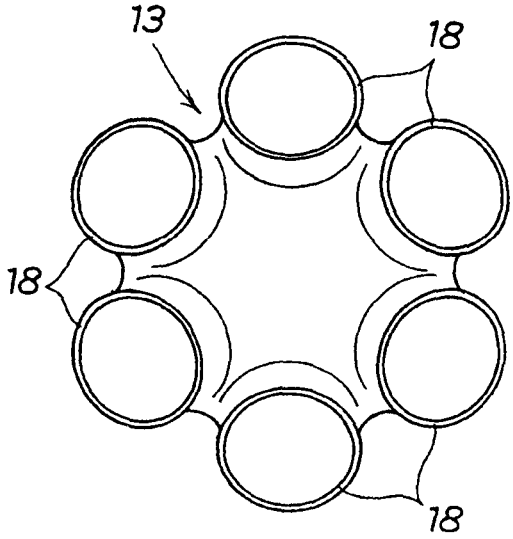
Figure 8:
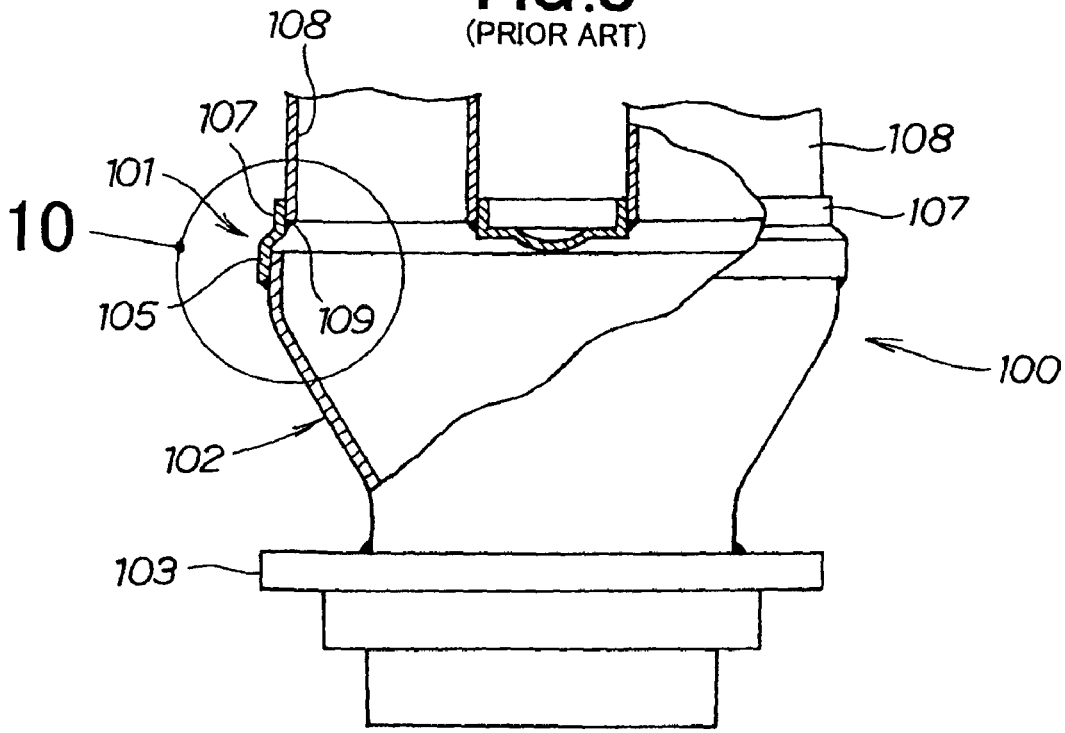
FIG.8 (PRIOR ART)
FIG. 8 is a schematic view illustrating, partially in section, a conventional assembly for fitting together a plurality of exhaust pipes.
Figure 9:
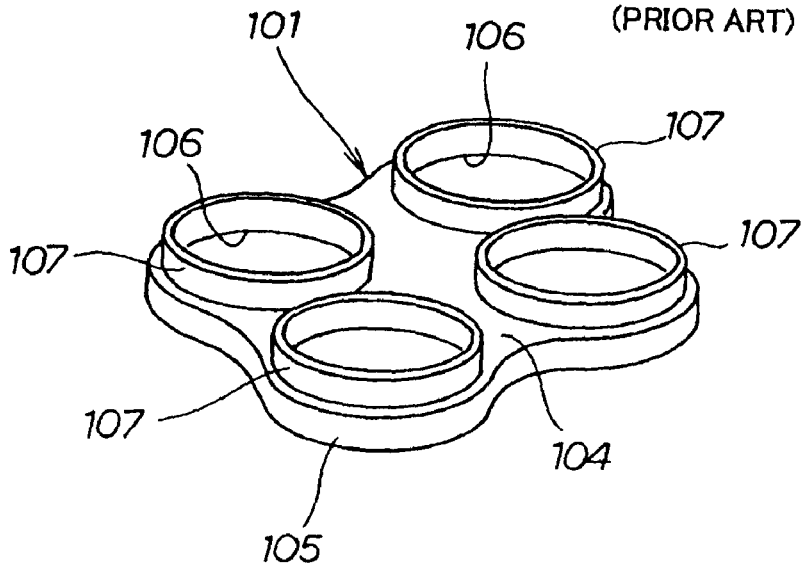
FIG.9 (PRIOR ART)
FIG. 9 is a perspective view of a perforated cap of FIG. 8.
Figure 10:
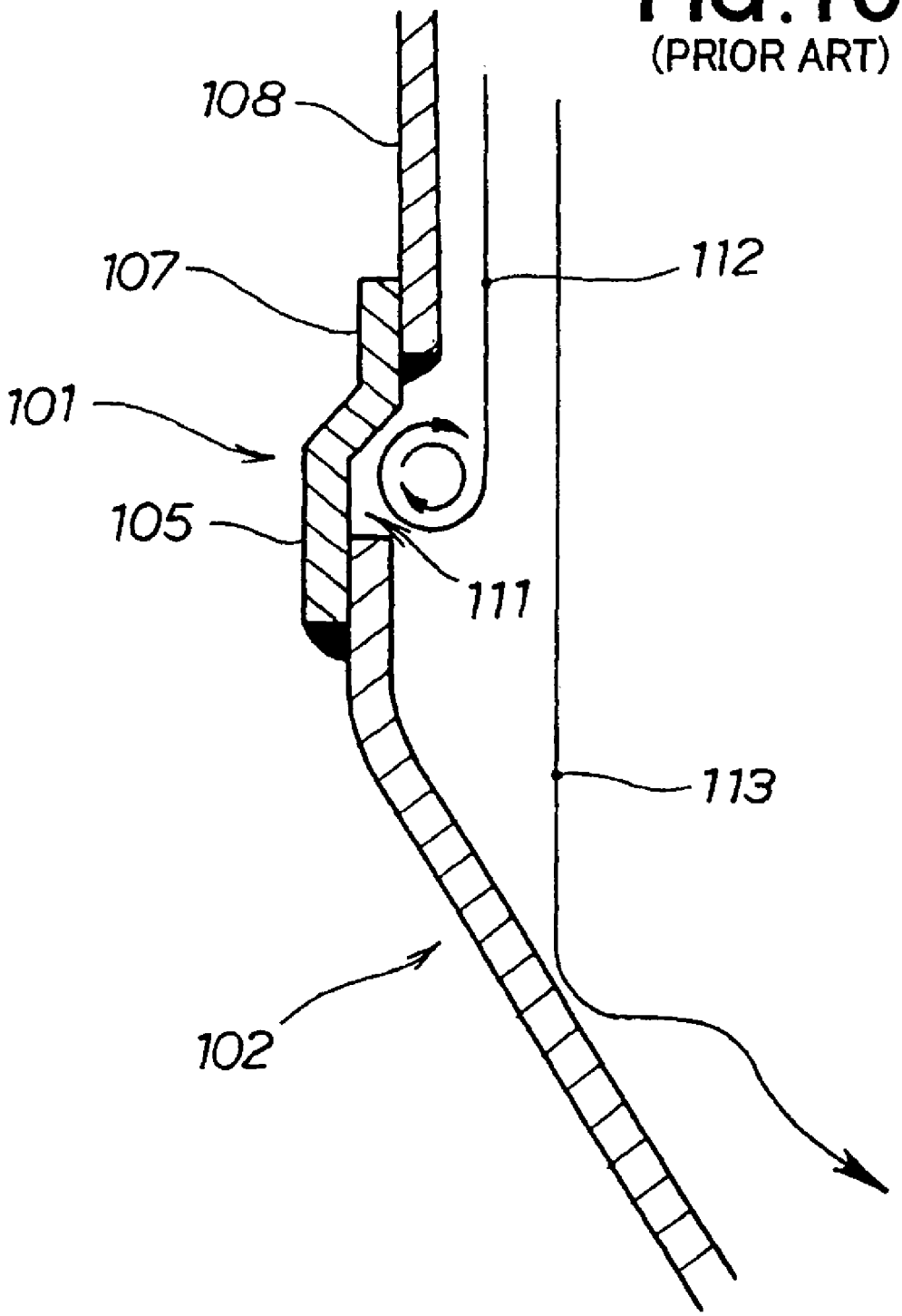
FIG. 10 (PRIOR ART)
FIG. 10 is an enlarged view of encircled part 10 of FIG. 8.

In FIG. 7D, an example is shown in which six sockets 18, 18, 18, 18, 18, 18 are provided in the perforated cap 13.

Specifically, the assembly for fitting together the exhaust pipes in a multi-cylinder engine can be used in a multi-cylinder engine having two or more exhaust pipes, and the number of cylinders is arbitrary.

Obviously, various minor changes and modifications of the present invention are possible in light of the above teaching. It is therefore to be understood that within the scope of the appended claims the invention may be practiced otherwise than as specifically described.

What is claimed is:

1. An assembly for fitting together a plurality of exhaust pipes in a multi-cylinder engine into a single unit, the assembly comprising:

a cap; and a choke pipe connected to cap, wherein the cap includes:

a surface;

a plurality of socket portions protruding from the surface in a direction opposite to the choke pipe and adapted to engage the exhaust pipes; and a skirt portion surrounding a perimeter of the surface and extending from the surface in a direction toward the choke pipe, wherein an internal surface of an approximate semi-circumferential portion of each of the plurality of socket portions, an internal surface of the skirt portion adjacent to the approximate semi-circumferential portion of the internal surface of each of the plurality of socket portions, and an internal surface of the choke pipe adjacent to the internal surface of the skirt portion are arranged linearly relative to each other.

2. The assembly of claim 1, wherein the approximate semi-circumferential portion of each of the plurality of socket portions is parallel to the internal surface of the choke pipe.

3. The assembly of claim 1, wherein the skirt portion has a flange at a bottom end thereof, the choke pipe has a flange at a top end thereof and the two flanges are joined by welding.

* * * * *